US011247137B2

(12) United States Patent
Briggs et al.

(10) Patent No.: US 11,247,137 B2
(45) Date of Patent: Feb. 15, 2022

(54) PLAY CENTER USING STRUCTURAL MONOLITHS FOR WATER DELIVERY CAPABILITIES

(71) Applicant: Whitewater West Industries Ltd., Richmond (CA)

(72) Inventors: Rick A. Briggs, Springfield, IL (US); Ryan G. Snyder, Rotterdam, NY (US)

(73) Assignee: Whitewater West Industries, Ltd., Richmond (CA)

( * ) Notice: Subject to any disclaimer, the term of this patent is extended or adjusted under 35 U.S.C. 154(b) by 0 days.

(21) Appl. No.: 16/806,158

(22) Filed: Mar. 2, 2020

(65) Prior Publication Data

US 2020/0269144 A1 Aug. 27, 2020

Related U.S. Application Data

(63) Continuation of application No. 15/812,711, filed on Nov. 14, 2017, now Pat. No. 10,576,388.

(60) Provisional application No. 62/421,925, filed on Nov. 14, 2016.

(51) Int. Cl.

| | |
|---|---|
| ***A63G 21/18*** | (2006.01) |
| ***A63B 9/00*** | (2006.01) |
| ***A63G 31/00*** | (2006.01) |
| *A63B 4/00* | (2006.01) |
| *A63G 21/00* | (2006.01) |
| *A63G 21/22* | (2006.01) |

(52) U.S. Cl.

CPC ..... *A63G 31/007* (2013.01); *A63B 9/00* (2013.01); *A63B 4/00* (2013.01); *A63B 2009/008* (2013.01); *A63G 21/00* (2013.01); *A63G 21/22* (2013.01)

(58) Field of Classification Search

CPC ..... A63G 31/00; A63G 31/007; A63G 21/00; A63G 21/22; A63H 23/00; A63H 23/10; A63B 2009/008

USPC ..... 472/117, 128; 446/153–159, 475

See application file for complete search history.

(56) References Cited

U.S. PATENT DOCUMENTS 5,839,964 A * 11/1998 Rudell ..... A63B 9/00 472/117

5,865,680 A * 2/1999 Briggs ..... A63B 9/00 472/128

(Continued)

*Primary Examiner* — Kien T Nguyen

(74) *Attorney, Agent, or Firm* — Buchalter, a Professional Corp.; J. Rick Tache

(57) ABSTRACT

A play structure having one or more monolith structures for the connection of other surfaces (e.g., deckings, water-based elements, interactive elements, etc.). Each of the monolith structures may be adjustably connected with a ground surface such that a variety of possible angles may be obtained by the monolith with respect to the ground surface. After the desired orientation of the monolith is obtained to the ground surface via the adjustable connection, the monolith may be secured in such position. Water or other fluid may be provided to the monolith structures via piping that interfaces with the monolith structures by a fluid connection that is in communication with piping disposed within the monolith structures. A fluid dumping or delivery system (e.g., based upon a tipping element that provides water to a fluid flowing surface and/or other water dispersion element) may be provided as part of the play structure.

11 Claims, 14 Drawing Sheets

(56) References Cited

U.S. PATENT DOCUMENTS

| | | | | |
|---|---|---|---|---|
| 6,210,287 | B1 * | 4/2001 | Briggs | A63G 31/00 273/394 |
| 2012/0021665 | A1 * | 1/2012 | Hunter | F16K 21/18 446/153 |
| 2012/0202608 | A1 * | 8/2012 | White | A63G 31/007 472/128 |
| 2017/0043266 | A1 * | 2/2017 | Tong | A63G 31/007 |
| 2019/0105575 | A1 * | 4/2019 | Brown | A63G 31/007 |

* cited by examiner

PLAY CENTER USING STRUCTURAL MONOLITHS FOR WATER DELIVERY CAPABILITIES

CROSS REFERENCE TO RELAXED APPLICATIONS

This application claims the benefit of U.S. Provisional Patent Application Ser. No. 62/421,925, filed on Nov. 14, 2016, entitled "PLAY CENTER HAVING MOUNTABLE MONOLITHS FOR WATER DUMPING CAPABILITIES," which is hereby incorporated by reference in its entirety.

BACKGROUND

1. Field of the Invention

The present invention relates to an apparatus, system, and/or method for providing or operating play centers, for example at waterplay or other amusement locations. More particularly, the present invention relates to an apparatus, system, and/or method for providing or operating play centers that use mountable panels or monoliths with other water providing or dumping capabilities.

2. Description of the Related Art

Play centers have become a popular form of entertainment and include both dry and wet variants. Dry play centers may be substantially free of fluid-based elements or components while wet play centers conventionally use various elements or components configured to spray or otherwise provide water in or to certain areas of the play center. Conventional play centers are often built upon a flat, horizontal surface and, for those play centers that incorporate water elements, are typically built around a system of "standpipes" (e.g., vertically plumbed structural members). Accordingly, conventional play structures require specific and significant site layout and construction coordination efforts.

Assembly of standpipes and other components in conventional play structures can involve complex systems of manufacturing, identification labeling, shipping, etc. and may require significant coordination of the manufacturing delivery and installation efforts. These factors can lead to a number of problems, such as misplaced hardware, during the build of a play structure. The weight and/or assembly requirements of convention play structures typically require the use of lifts (e.g., heavy equipment cranes) for extended assembly periods, which can cause higher construction costs, increased erection timelines, and potential damage to the build site and/or equipment, among other problems. Moreover, conventional play structures are generally fixed or rigid by the nature of their standardized layouts and are not easily customized to accommodate a unique site condition or designer-based intentions, particularly if the floor or ground of a site is not flat and/or horizontal.

Ideally, an improved play center or play structure (e.g., either wet or dry) would address one or more of the above issues via novel component parts and/or assembly requirements that reduce or eliminate the problems associated with conventional structures. Moreover, as play centers and/or play structures are often installed in locations seeking to encourage customers to visit the location and/or associated locations (e.g., within a waterpark), new play or interactive elements having novel features are also ideally included as part of an improved play center so as to garner excitement and attention from customers.

SUMMARY

The present invention is related to an apparatus, system and/or method for providing play centers having mountable panels or monoliths in combination with or, in the alternative, provision of other water providing or dumping capabilities. In one embodiment, a fluid delivery system may include a fluid delivery element configured to contain a volume of fluid and release such fluid, a fluid flowing element positioned adjacent to the fluid delivery element and configured to receive at least a portion of the volume of fluid from the fluid delivery element, and a fluid dispersion element positioned adjacent to the fluid flowing element and configured to engage at least a portion of the volume of fluid from the fluid flowing element.

In another embodiment, a play structure may include a monolith that has a frame, a connector for fastening the monolith to a ground surface, a first surface connected with the frame, a second surface connected with the frame opposing the first surface, wherein a cavity is formed between the first surface and the second surface, and a fluid conduit disposed within the cavity formed between the first surface and the second surface. The play structure may include a decking connected with the monolith and a fluid-based element connected with the monolith, wherein the monolith is configured to rotate with respect to the ground surface via the connector.

In still another embodiment, a play structure disposed upon a surface may include a base segment, a leveling element connected with the base segment for adjusting a distance of the base segment from the surface, a frame connected with the base segment, a decking connected with the frame, a fluid delivery element configured to contain a volume of fluid and release such fluid via pivoting of the fluid delivery element, and a rotatable fluid dispersion element configured to receive at least a portion of the volume of fluid from the fluid delivery element.

BRIEF DESCRIPTION OF THE DRAWINGS

The features, objects, and advantages of the present invention will become more apparent from the detailed description set forth below when taken in conjunction with the drawings, wherein.

DETAILED DESCRIPTION

The detailed description of exemplary embodiments herein makes reference to the accompanying drawings and pictures, which show the exemplary embodiment by way of illustration and its best mode. While these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for purposes of illustration only and not of limitation. For example, the steps recited in any of the method or process descriptions may be executed in any order and are not limited to the order presented. Moreover, any of the functions or steps may be outsourced to or performed by one or more third parties. Furthermore, any reference to singular includes plural embodiments, and any reference to more than one component may include a singular embodiment.

Figure 1A:
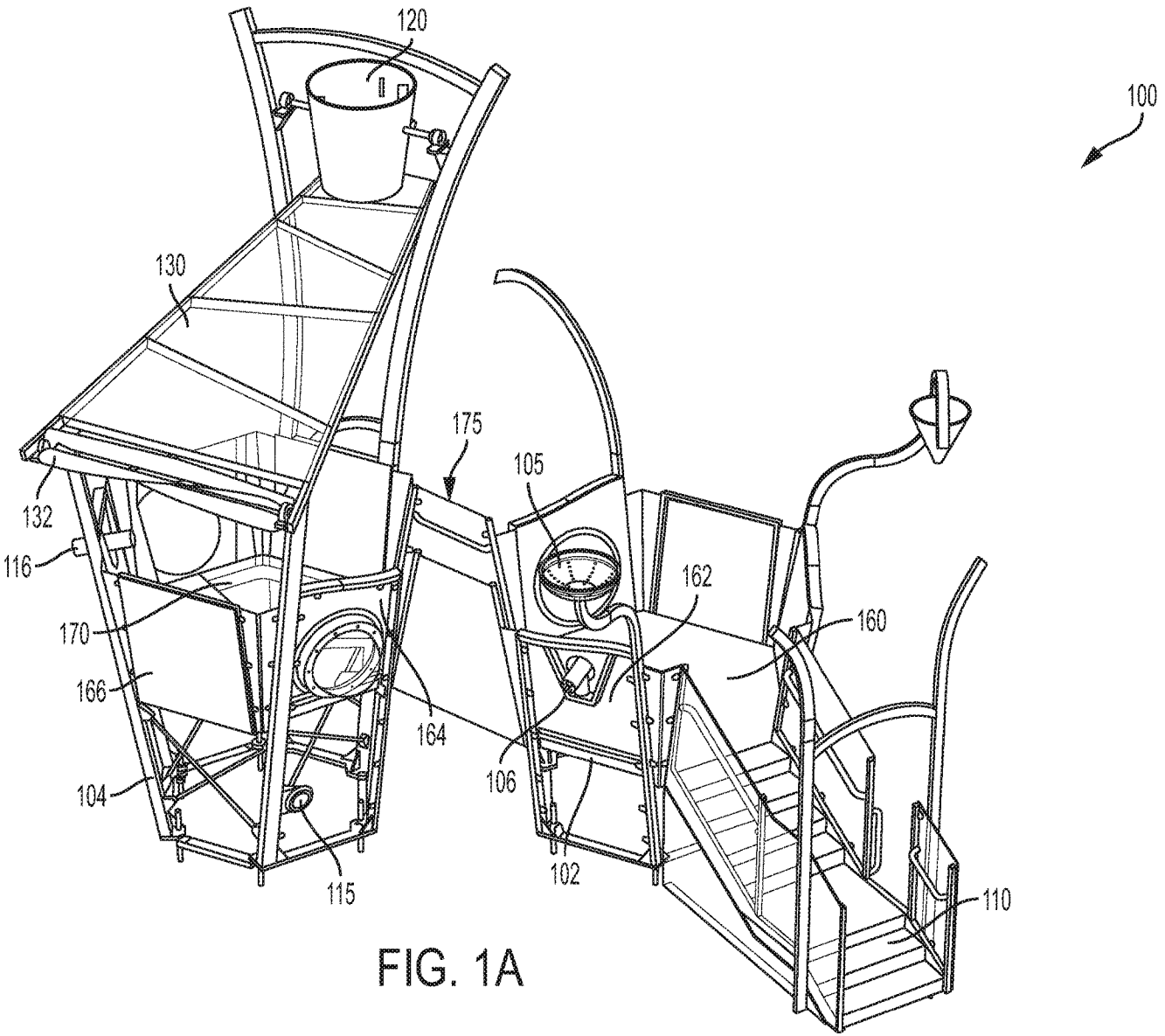
FIG. 1A shows a perspective view of a monolithic-based play structure, according to one embodiment of the present invention.

FIG. 1A shows a perspective view of a monolithic-based play structure 100. Although the play structure 100 is illustrated as incorporating a variety of wet elements (e.g., water dumpers, sprayers, jets, etc.), in an alternative embodiment, additional fewer, and/or different wet or dry elements may be used. For example, in one embodiment, the play structure 100 may be a dry play structure that does not include any play elements or components that utilize fluids such as water.

The play structure 100 is formed via one or more frames, such as frame 102 and frame 104, that may be made out of any of a variety of desired materials (e.g., steel, aluminum, carbon fiber, etc.) that is either formed as a single shape (e.g., rectangle) and/or may be formed via the connection (e.g., bolts, screws, welding, etc.) of smaller frame members (e.g., straight or curved bars) to form the frames 102, 104. For example, as explicitly illustrated in FIG. 1A, the frames 102, 104 are substantially rectangular in shape. As discussed in greater detail herein, the frames 102, 104 may be positioned at any of a variety of desired angles with respect to a floor or surface that the play structure 100 is disposed upon.

Certain embodiments may not have the one or more frames 102, 104 explicitly fastened or connected with the floor or ground via a stable connector at all (e.g., the frame 102 and/or frame 104 may merely rest upon the floor, ground, or other surface). In some embodiments, the frames 102, 104 may be connected with the floor at a substantially 90-degree angle. In another embodiment, the frames 102, 104 may be connected with the floor at a greater than or less than 90-degree angle. In still further embodiments, the frames 102, 104 may be connected via one or more components that allow the frame 102 to have an adjustable angle (e.g., which may be adjusted and/or rotated and then fastened or otherwise locked or fixed in place to form a stabilized structure). In an alternative embodiment, the frame 102 and/or frame 104 may be connected with another base structure or segment that is in contact with a ground or flooring surface (e.g., concrete), for example, as illustrated and/or discussed in greater detail for FIGS. 1B and/or 1C.

As discussed in greater detail herein, the frame 102 may have other components, such its paneling 162, 164, and/or 166 that may or may not include other features or elements as part of or connected with the paneling (e.g., a translucent bubble or view-hole that encourages users to look there through as explicitly shown for paneling 164). This connection of paneling with frame demerits form a "monolith" structure and multiple such monoliths may be used to create a modular play structure, as discussed in greater detail herein. The use of multiple frames or monoliths may be used to form a structure that other elements or surfaces can be connected with, as discussed in greater detail herein. The paneling 162 may be connected as part of a monolith and incorporate interactive elements, such as water sprayers, etc., configured to emit water to an area exterior to the paneling 162. The paneling 166 may not include any connection or capability for interactive elements thereon or there through and remain merely an external paneling for the monolith. In certain embodiments, such paneling (162, 164, 166) may provide desired functional features of the play structure 100 (e.g., additional rigidity, additional surfaces for the connection of elements, such as water jets, etc.) with a variety of possible theming, color, and/or shapes or configurations.

For example, the play structure 100 explicitly illustrated in FIG. 1A includes a first decking 160 connected with the frame 102, a second decking 170 connected with the frame 104, and a pathway 175 (e.g., walkway, staircase, etc.) that connects the first decking 160 and the second decking 170 and a staircase 110 so that users may travel thereon or there between. In this fashion, by using a plurality of one or more frames or monoliths with other elements or surfaces connected therewith, a larger play structure or assembly can be formed that incorporate any of a variety of possible entertainment structures ((stairs, ramps, walkways, slides, bridges, such as rope bridges, poles, balancing beams, monkey-bars, zip-lines, etc.). In certain embodiments, such interconnection of other elements or surfaces with the one or more frames, such as frame 102 and/or frame 104, or monoliths may allow for more easily customized and/or modular play structures be formed, when compared to conventional play structures.

The play structure 100 also includes a variety of other interactive or play elements that may be connected with the one or more frames or monoliths and/or their connected elements or other surfaces, as described above. For example, in a wet play structure that includes elements or components that interface with fluids, such as water, a first fluid component 106 (e.g., a water spout, geyser, gun, and/or jet) may be connected or integrated with the one or more monoliths (e.g., frame 102 and/or paneling 162). The first interactive fluid component 106 may automatically spout or provide water (e.g., constantly and/or at predetermined intervals) and/or may be initiated with by users (e.g., a user may interface with a control that is connected with the jet 106, causing the jet 106 to either spout to stop spouting water and/or provide the water in a particular direction). In one embodiment, the first interactive fluid component 106 may be indirectly interacted with by a user (e.g., a user may interact with a separate interactive element or component 115 (e.g., a button, lever, switch, etc.) disposed on or associated with the play structure 100 and a such interactive element or component 115 interfaces with the first interactive fluid component 106, either randomly or non-randomly, to aim and/or otherwise cause the disposal of water upon the user or an area, and/or cause some other operation of the play structure 100. A second interactive fluid component 116 is also connected or integrated with one or more monoliths (e.g., frame 104) and may be the same or similar to the first interactive fluid component 106 (e.g., may be a water spout, geyser, gun, and/or jet). Other non-interactive fluid components, such as non-interactive fluid component 105, may additionally and/or alternatively be disposed around the play structure 100 and may, for example, provide water that showers down onto users without requiring the users to interact with the non-interactive fluid component 105 itself, either directly or indirectly.

A fluid (e.g., water) dumping element 120 (e.g., bucket, cylinder, barrel, or other vessel configured to hold a volume of fluid and subsequently release the fluid) may be connected or positioned adjacent to one or more fluid run-off elements 130, as discussed in greater detail herein. The fluid dumping element 120 allows for water to build up or otherwise be contained within the fluid dumping element 120 and subsequently dump, pour, or otherwise provide all or a portion of the fluid within the fluid dumping element 120 onto the one or more fluid run-off elements 130. In another embodiment, the fluid dumping element 120 and/or other associated elements, for example as discussed in greater detail herein, need not be adjacent to the fluid run-off elements 130 (e.g., may be connected with, not connected with, incorporated into, positioned within proximity of, and/or the fluid dumping element 120 and fluid run-off elements 130 may be standalone without the other). The one or more fluid run-off elements 130 may provide additional features or characteristics to the run-off of fluid in order to splash, rain, or otherwise provide fluid onto users, the ground, and/or other portions of the play structure positioned below.

A fluid encountering or dispersion element 132 may be disposed adjacent or integrated with the fluid run-off elements 130, for example, to encounter with fluid after the fluid has traveled or flowed along the fluid run-off elements 130. For example, in one embodiment, the fluid encountering element 132 may include one or more fins that are configured to rotate about an axis when a fluid, such as water, encounters one or more of the fins. The rotation of the fins in response to encountering the fluid may cause the fluid to spray or otherwise be splashed in an entertaining manner rather than merely running off of the fluid run-off elements 130 had no fluid encountering element 132 been disposed at the end of the fluid run-off elements. Although a particular fluid encountering element 132 having particular features (rotatable with fins, etc.) is explicitly shown in FIG. 1A, any of a variety of other elements or components may be positioned at an end of a fluid run-off element, or intermediate along a fluid run-off element, and/or adjacent to a fluid dumping element 120, in an alternative embodiment.

Although particular structures having particular shapes, configurations, sizes, and/or interconnections are specifically illustrated in FIG. 1A, any of a variety of possible structures or surfaces may be used in an alternative embodiment. For example, one or more slides, walkways, bridges, balancing beams, overhead bars, zip-lines, stairs, ramps, etc. may additionally and/or alternatively be used for an alternative play structure and may be connected with the one or more frames or monoliths in an alternative embodiment. Any of a variety of various play structures, surfaces, components, and/or interactive elements may be included as part of an alternative play structure, in any of a variety of configurations, positions, shapes, and/or combinations, either adjacent to one another and/or as standalone structures, surfaces, components, and/or interactive elements.

Figure 1B:
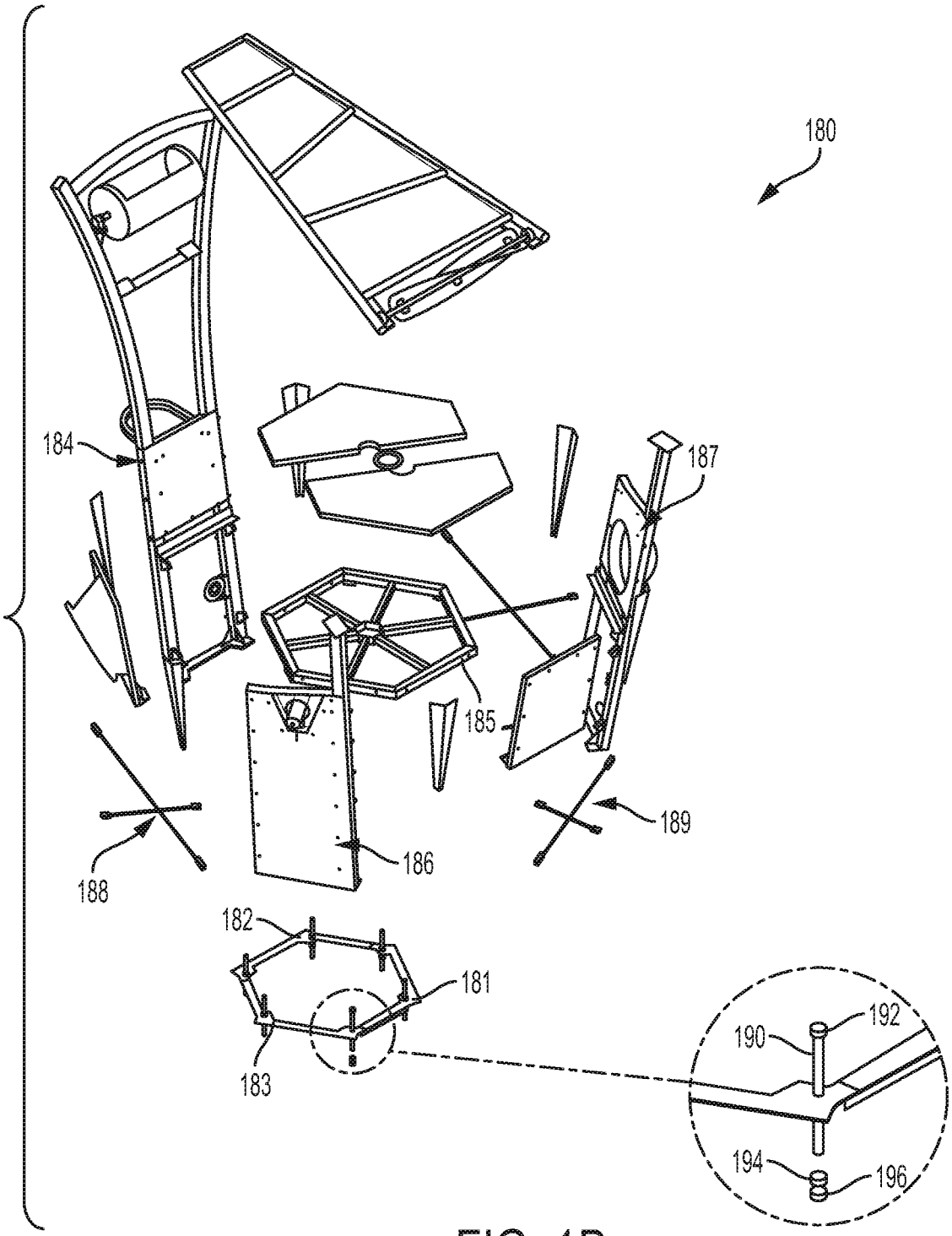
FIG. 1B shows an exploded perspective view of a monolithic-based play structure, such as a monolith-based play structure the same as or similar to that of FIG. 1A, according to one embodiment of the present invention.

FIG. 1B shows an exploded perspective view 180 of a monolithic-based play structure, such as a monolith-based play structure the same as or similar to that of FIG. 1A. Certain features of the play structure may be the same as or similar to those discussed. The monolith-based play structure shown in the exploded perspective view 180 illustrates one embodiment for connection of a first monolith 184 with a second monolith 186 and a third monolith 187, for example with a stabilizing and/or leveling system, as discussed in greater detail herein. The stabilizing and/or leveling system may aid in stabilizing the play structure for use by one or more users and/or allow the play structure to be constructed on surfaces (e.g., ground or flooring surfaces) that exhibit varying degrees of topography (e.g., are not completely flat).

The stabilizing and/or leveling system as illustrated in FIG. 1B includes a first base segment 182, a second base segment 183, and a third base segment 181. The first monolith 184 may be configured to connect (e.g., fixedly or adjustably, for example, via a connector configured to allow rotation and/or other movement) with the first base segment 182, the second monolith 186 may be configured to connect (e.g., fixedly or adjustably, for example, via a connector configured to allow rotation and/or other movement) with the second base segment 183, and the third monolith 187 may be configured to connect (e.g., fixedly or adjustably, for example, via a connector configured to allow rotation and/or other movement) with the third base segment 181. In an alternative embodiment, any of a number of base segments and/or monoliths may be used, in any of a variety of possible shapes or orientations.

As illustrated in the zoomed-in portion of FIG. 1B, a leveling component 190 (e.g., a rod, bar, or other elongated element) is configured to extend through one or both of the second base segment 183 and/or the third base segment 181. A first locking element 192 (e.g., a nut) is configured to at least partially surround the leveling component 190 (e.g., may rotate onto threads of the leveling component 190) such that, when in the desired position, abuts against or contacts a top surface of one or both of the second base segment 183 and/or the third base segment 181. Similarly, a second locking element 194 (e.g., a nut) is configured to at least partially surround the leveling component 190 (e.g., may rotate onto threads of the leveling component 190) such that, when in the desired position, abuts against or contacts a bottom surface of one or both of the second base segment 183 and/or the third base segment 181.

Thus, by adjusting the positioning of one or both of the first locking element 192 and/or the second locking element 194 along the length of the leveling component 190, a desired portion of the total length of the leveling component 190 will extend on either side (top and/or bottom) of one or both of the second base segment 183 and/or the third base segment 181. A stabilizing element 196 (which may be the same as or different from the first and/or second locking elements 192, 194 is disposed over or at an end of the leveling component 190 and, for example, configured to make contact with a ground or flooring surface, or other component connected with a ground or flooring surface (e.g., a bracket). By adjusting the positioning of the first locking element 192 and/or the second locking element 194, the height from the ground or flooring surface of one or both of the second base segment 183 and/or the third base segment 181 may be altered, for example, to accommodate topography of the ground or flooring surface.

As shown in FIG. 1B, multiple leveling components 190 and its associated locking and/or stabilizing elements (192, 194, 196) are disposed and connected with the base segments (182, 183, 181) such that the base segments (182, 183, 181) may accordingly have one or more of their heights from the ground or flooring surface adjusted independently. Thus, a ground or flooring surface with non-uniform topography may still result in a stable (e.g., horizontal or other desired orientation of base segments (182, 183, 181)) through adjustment of the multiple leveling components 190, as described above.

A support structure 185 (e.g., made of one or more support bars or components) is configured to engage with one or more of the base segments (182, 183, 181), for example, directly through bolts, screws or the like and/or indirectly through connection with one or more of the monoliths (184, 186, 187), such monoliths being connected with the one or more base segments (182, 183, 181). As illustrated, the base segments (182, 183, 181) and/or the support structure 185 may form the shape of a hexagon (e.g., may have corresponding shapes to one another), however, in an alternative embodiment, any of a variety of possible shapes and/or configurations may be used for the support structure 185 and/or the base segments (182, 183, 181). A first one or more stabilizing bars 188 may connect between the first monolith 184 and the second monolith 186. Likewise, a second one or more stabilizing bars 189 may connect between the second monolith 186 and the third monolith 187. Such stabilizing bars may aid in the structural rigidity of the play structure. In alternative embodiments, greater or fewer (e.g., no stabilizing bars) may be used.

As shown, a variety of possible monoliths and/or other play structure components (staircases, slides, walkways, etc.) may be configured to connect along the edges or sides of the support structure 185 (e.g., along one or more of each of the 6-sides of the hexagon shape). Accordingly, the play structure using such features may be modular in construction, such that different play structure components and/or layout for the play structure may be easily chosen and manufactured according to such choices simply by connecting such monoliths or play structure components along the desired edges or sides. In this fashion, play structures can be easily and modularly designed and/or manufactured or constructed on-site, in conjunction with any of a variety of topographies of a ground or flooring surface by adjusting the stabilizing or leveling system accordingly.

Figure 1C:
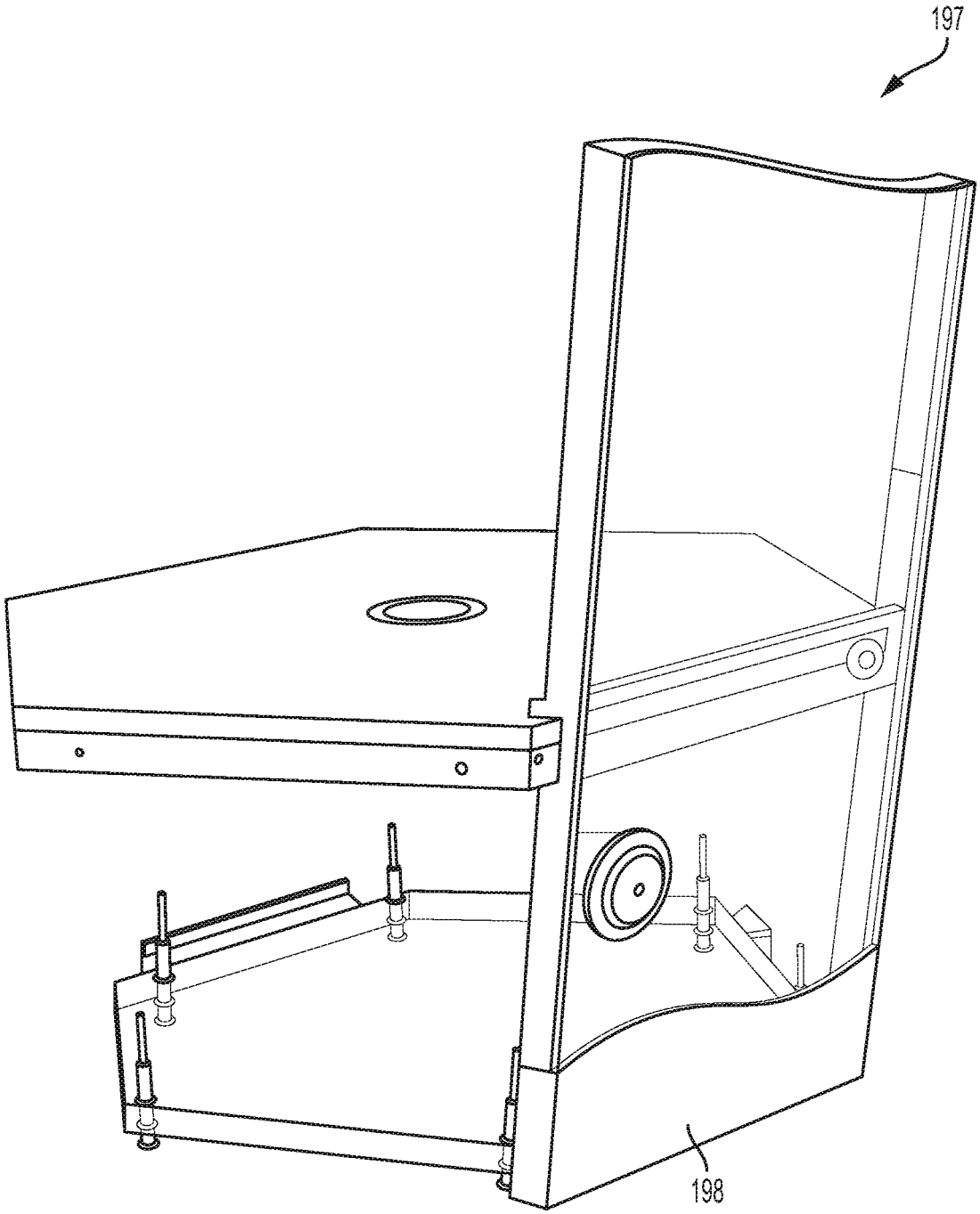
FIG. 1C shows a perspective view of a portion of a monolithic-based play structure, such as a monolith-based play structure the same as or similar to that of FIG. 1A, according to one embodiment of the present invention.

FIG. 1C shows a perspective view 197 of a portion of a monolithic-based play structure, such as a monolith-based play structure the same as or similar to that of FIG. 1A. As discussed above, for example for FIG. 1B, one or more base segments of a play structure may be adjustably positioned at a desired height above a ground or flooring surface. A cover 198 (e.g., having an adjustable height) for a monolith may be connected at a lower or bottom portion of the monolith in order to cover a gap that exists between a bottom edge of the monolith and/or the base structure due to the adjusted height.

Figure 2:
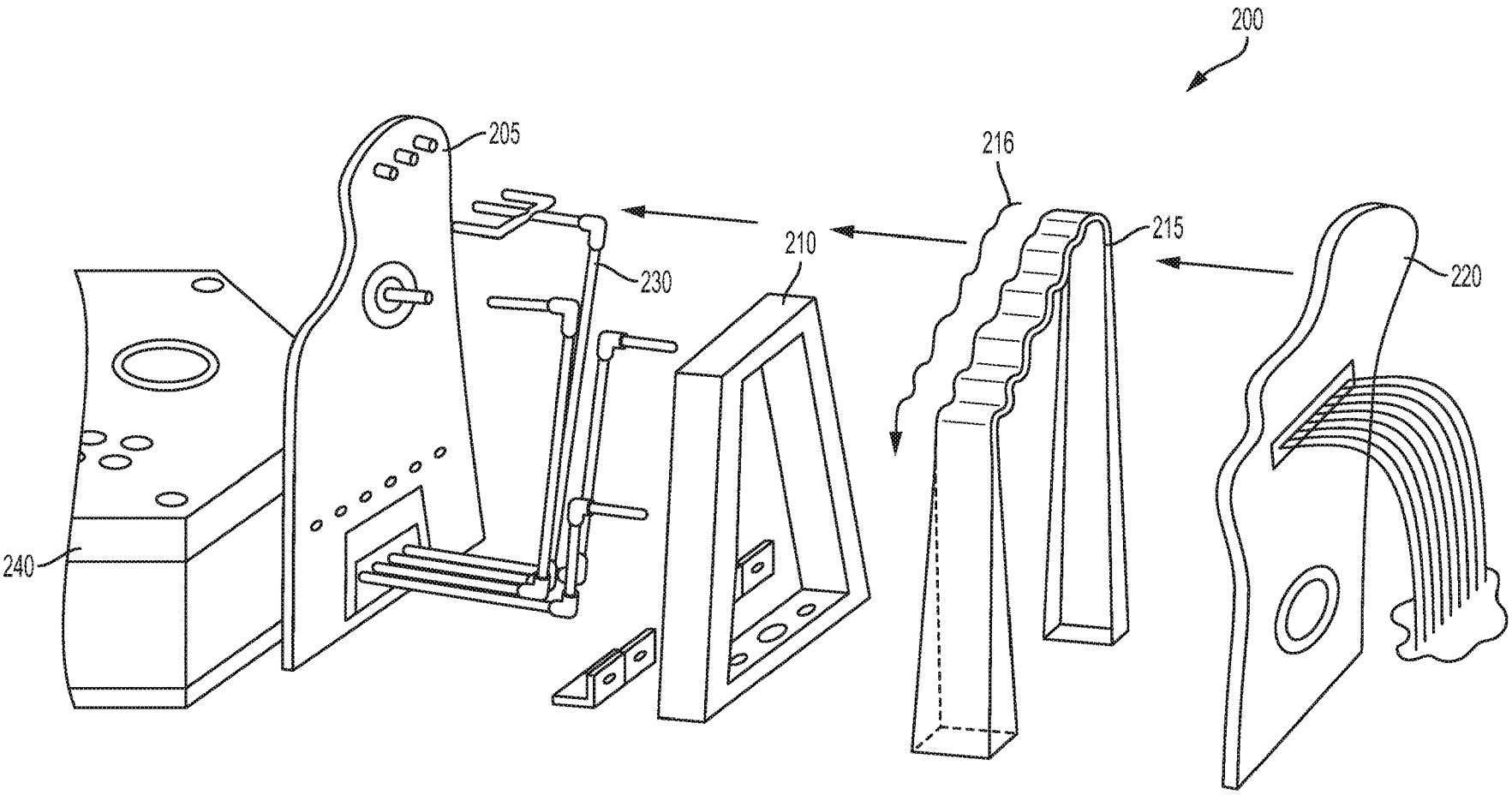
FIG. 2 shows a perspective view of a plurality of monoliths for use in a monolithic-based play structure, according to one embodiment of the present invention.

FIG. 2 shows a perspective view 200 of a plurality of components (205, 210, 215, 220) that make up an exemplary monolith structure for use in a monolithic-based play structure. Certain features of one or more of the plurality of components (205, 210, 215, 220) may be the same as or similar to those previously discussed (e.g., such monolith structures may be formed of a variety of potential materials and/or formed via connection of one or more paneling to a frame and/or may comprise merely a frame or merely paneling without the other).

The monolith structure may be composed of a first component 205 that includes a first side or surface (e.g., a side facing a decking, 240) and a second side or surface (e.g., a side that is not facing the decking 240). The first side or surface may be spaced apart from the second side or surface (e.g., parallel to the first side or surface) such that there is a gap between the first side and the second side (e.g., to accommodate associated equipment that corresponds with the first component 205 such as piping or plumbing, mechanical equipment or connections, electrical equipment or connections, etc.). In certain embodiments, the first component 205 may be paneling such that there is no gap or cavity therein. Piping 230 is shown connected with portions (e.g., a mechanical connection of the monolith 205 that provides access to additional piping disposed within the gap of the first side and the second side of the first component 205 and/or with other fluid components connected with the first component 205). Water may be configured to flow from the piping 230 to the first component 205 in order to be communicated to any of a variety of additional elements or devices, such as water spinners, water geysers, water jets, etc. that are connected with the first component 205. A decking 240 may be connected with the first component 205, the decking permitting users to travel thereon in certain embodiments. Multiple monoliths may be connected to the decking 240 in certain embodiments in order to construct a desired play structure. In one embodiment, piping 230 may be connected beneath and/or fastened to the decking 240 in order to provide a flow of water via the piping 230 to various components associated with the decking 240 (e.g., floor geysers) and/or to route the piping to other monoliths structures. In an alternative embodiment, rather than additional piping 230, fluids and/or electricity may be configured to flow through a frame of the first component 205 (or other components as discussed) itself.

A second component 210 may also be used in a play structure, but formed differently than the first component 205 in that it forms a frame or structure with an interior opening or cavity that is bounded fully by the frame or structure. Similar to the first monolith 205, an interior cavity of the frame or structure may permit equipment, piping, or plumbing to be disposed therein (e.g., water piping to allow for a flow of water to be transmitted through the frame or structure to an output connection and/or output device located on some portion of the second monolith 210.) Second component 210 may be configured to abut against and/or be fixed to the first component 205.

A third component 215 may be similar to the second monolith 210, but instead of having its cavity being fully bounded by its frame or structure, the cavity is illustrated as only being partially bounded (e.g., the cavity is open at a bottom portion that rests on the floor or ground). The third component 215 also illustrates a possible water dumping or water sprinkling feature wherein a cascade of water may be permitted to travel down or along a portion (e.g., a top part) 216 of die third component 215. This portion for wider cascading may be shaped so as to provide a visually interesting stream of flow of water and/or to provide a particular water cascading effect onto users or other components located beneath the water cascade. The third component 215 may be configured to abut against and/or be fixed to the second component 210. A fourth component 220 may be similar to the first monolith 205 and include one or more water elements (e.g., water spinners, controls, geysers, etc.) while also providing openings to allow water to spill there through. The fourth component 220 may be configured to abut against and/or be fixed to the third component 215. As previously discussed, a play structure, such as play structure 100, may be formed of one or more monoliths, the same as or similar to the construction shown in FIG. 2 alone or in conjunction with any of a variety of possible structures or components that may be interacted or used by a user (e.g., stairs, railings such as transparent railings, deckings such as transparent deckings, nettings, ropes, slides, etc.). In an alternative embodiment, greater or fewer components may be used in creating a monolith (e.g., a monolith may be formed using only a single frame and a single panel connected on one side of the frame, with or without any piping or other components (fluid, mechanical, electrical, etc.) disposed within open space of the frame.

Figure 3A:
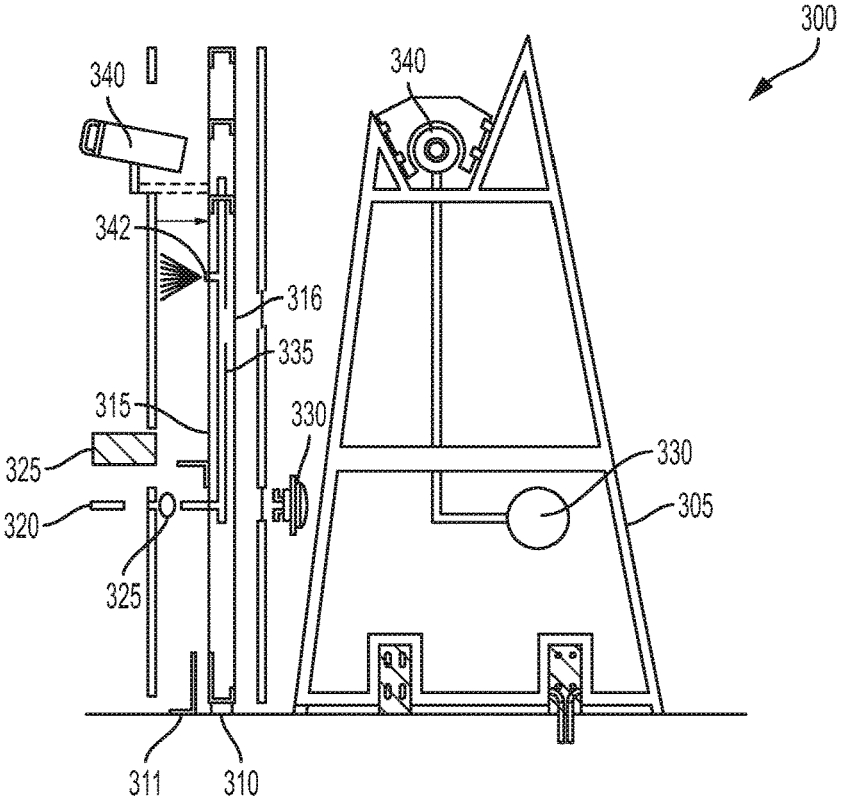
FIG. 3A shows a cross-sectional side view and a front view of a monolith for use in a monolithic-based play structure, according to one embodiment of the present invention.

FIG. 3A shows a cross-sectional, exploded side view and a front view of a monolith 300 for use in a monolithic-based play structure. Certain features of the monolith 300 may be the same as or similar to those previously discussed. The monolith 300 may have an exterior frame 305 that substantially forms the outer perimeter or shape of the monolith 300. As seen by the cross-sectional side view (the left-most view of FIG. 3A) of the monolith 300, a first side or surface 315 may be disposed across an inner cavity from a second side or surface 316 such that the cavity may be used for placement of additional equipment (e.g., piping or plumbing 335). A piping or other fluid (e.g., water) supply 320 that is positioned outside of the monolith 300 may be connected with the piping or plumbing 335 via a connector 325 (e.g., a flex connector) that is located and/or fixed upon the first side or surface 315 of the monolith 300. Any of a variety of components configured to flow or otherwise interface with the fluid from the supply 320 may also or alternatively be connected with the monolith 300 and interface with the piping or plumbing 335.

As previously discussed, the monolith 300 may be connected with a ground or floor via a connector 310 (e.g., an adjustable connector that allows the monolith 300 to pivot or rotate with respect to the ground or floor before being kicked into its desired position, such as via an additional or multiple additional clamps or brackets 311). Various connections for the attachment of other surfaces or parts (e.g., deckings) may be integrated or configured to be attached the monolith 300. One or more fluid delivery components (340, 342) may be connected with the piping or plumbing 335 in order to receive fluid from the fluid source 320. Likewise, an interactive element 330, for example, a button or other user-manipulatable element, may interface with the fluid source 320, piping or plumbing 335, and/or the one or more fluid delivery components (340, 342) or other components of the monolith 300 in order to control and/or cause fluid flow to either be emitted by the one or more fluid delivery components (340, 342) or not to be emitted by the one or more fluid delivery components 340, 342).

Figure 3B:
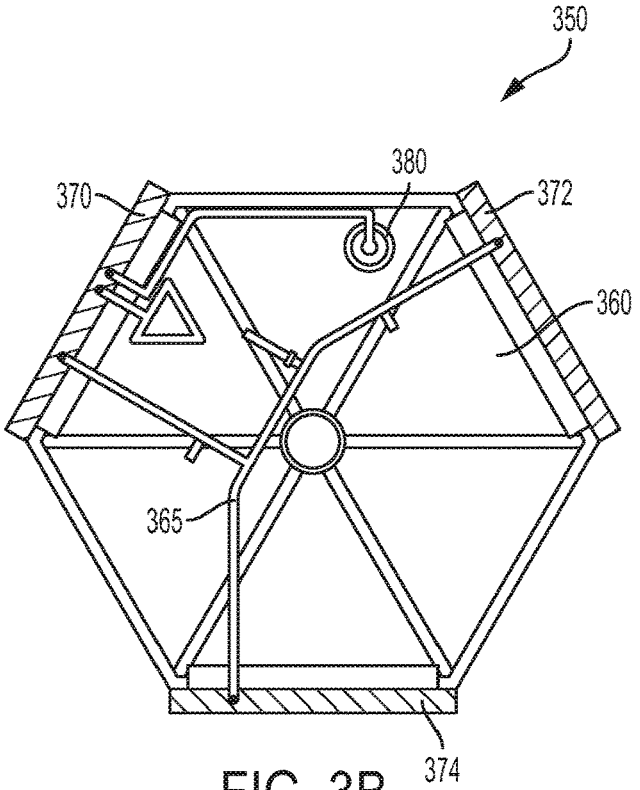
FIG. 3B shows a bottom view of a portion of a monolithic-based play structure using a monolith structure, such as a monolith the same as or similar to that of FIG. 3A, according to one embodiment of the present invention.

FIG. 3B shows a bottom view of a portion 350 of a monolithic-based play structure using monolith structures, such as the monolith 300 of FIG. 3A. Certain features of the play structure and/or monoliths may be the same as or similar to those previously discussed. For example, the portion 350 of the play structure is shown and illustrated from a bottoms-up view that shows beneath a decking 365 connected with three monoliths (370, 372, 374) and has associated piping 365 for the transmittal of fluid (e.g., water) to components associated with each of the three monoliths (370, 372, 374). Such piping may be hidden from user view due to its placement on a bottom side of the decking 365. A fluid geyser or other component 380 disposal within or connected with the decking 365 may be configured to spout fluid from the piping 365 in an upward direction, for example automatically based upon time and/or in response to user interaction, for example based upon a foot pedal, button, and/or other activator. In alternative embodiments, various other equipment may be installed, for example, as previously discussed.

Figure 4:
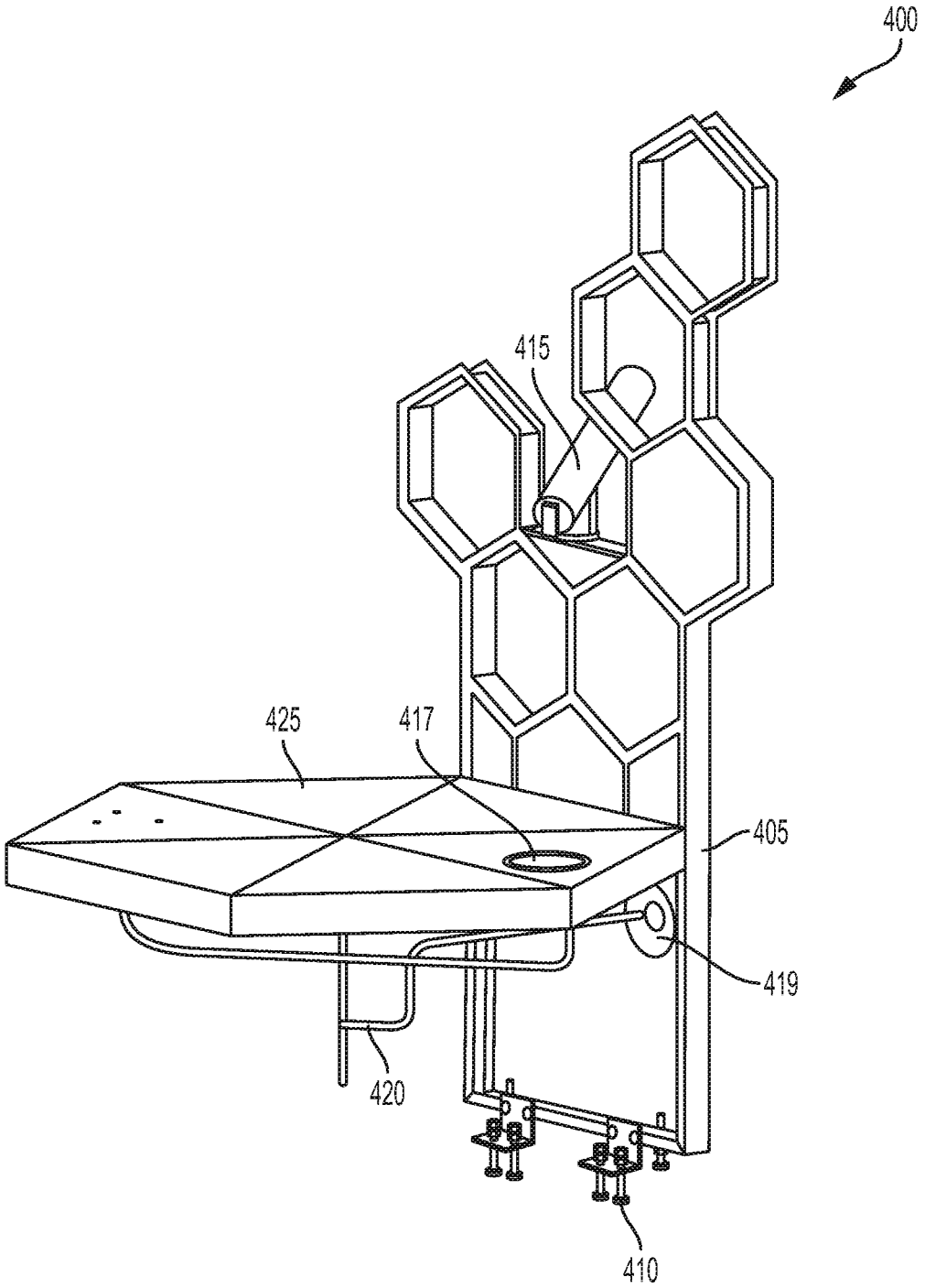
FIG. 4 shows a side schematic view of a monolith connected with a decking for use in a monolithic-based play structure, according to one embodiment of the present invention.

FIG. 4 shows a side schematic view of a portion of a play structure 400 including a monolith 405 connected with a decking 425. Certain features of the play structure 400 and/or the monolith 405 and/or the decking 425 may be the same as or similar to those previously discussed. For example, the monolith 405 may be connected with a ground or floor surface 410, for example via a rotatable or otherwise movable connection (e.g., one or more pivotable hinges) that may be further locked into a fixed or rigid orientation, either via the rotatable or otherwise movable connection itself or via additional parts (e.g., one or more fixed brackets, such as L-brackets). The decking 425 may be connected with a portion of the monolith 405, for example, in order to provide the decking 425 at a raised elevation supported by one or more monoliths 405 spaced at locations dong the perimeter of the decking 425. Plumbing or pipes 520 may extend from the ground or floor surface 410 (e.g., may receive fluid via reservoirs, pumps, etc. located beneath the ground or floor surface 410) and are connected to an underside of the decking 425 and carry such water to the one or more monoliths 405, for example, to provide the fluid to components connected with the one or more monoliths 405, such as water spouts, etc. The monolith 405 may be formed in any of a variety of shapes, patterns, configurations, etc., such as hexagons as illustrated. Such shapes, patterns, and/or configurations may be formed as an integral part of the monolith 405 itself and/or may be formed by paneling in such shapes, patterns, and/or configurations that are attached to the monolith 405 structure.

In one example, the monolith 405 may be constructed via one or more frame components that surround all or a portion of a perimeter of the monolith 405. In certain embodiments, further side or surface materials may be connected with the one or more frame components to form die monolith 405 such that a cavity or gap exists between the side or surface materials, the same or similar as previously discussed. One or more interactive elements, such as a water gun 415, floor geyser 417, touch/spin turbine 419 (e.g. a button that includes spinning turbine contained within that engage or otherwise interact with water) or other fluid-based component may be connected with the monolith 405 and/or the decking 425 and be in communication with piping or plumbing 420 that resides within the cavity or gap between the side or surface materials of the monolith 405 and/or underneath the decking 425 (or otherwise disposed along the play structure 400) that carries water to the interactive elements (415, 417, and/or 419).

Figure 5A:
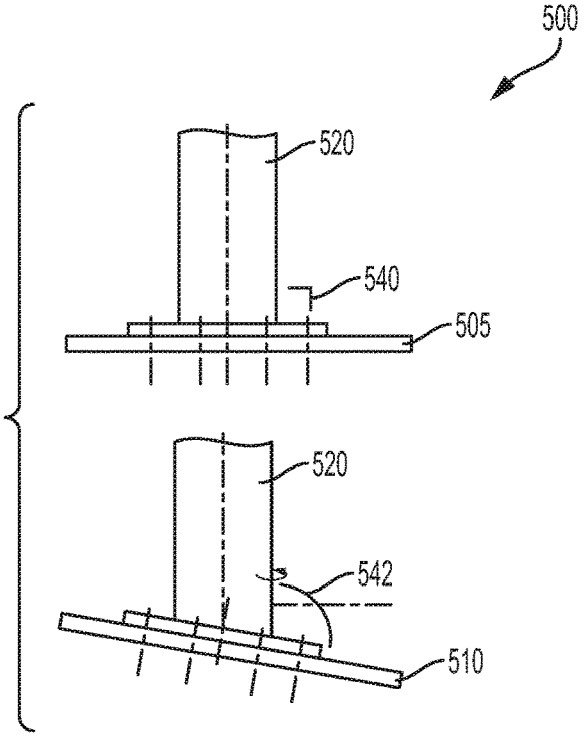
FIG. 5A shows a side view of a monolith for a monolith-based play structure connected with a plurality of ground angles, according to one embodiment of the present invention.

With respect to the connection of monoliths to a floor, ground, or other surface, as previously discussed, FIG. 5A shows a side view 500 of a monolith 520 that is connected with a horizontal floor surface 505, in one embodiment illustrated at a top of FIG. 5A, and an angled floor surface 510, in another embodiment illustrated at a bottom of FIG. 5A. The monolith 520 may include features that are the same as or similar to those previously discussed. The monolith 520 may form a substantially 90-degree angle (e.g., angle 540) with the floor surface 505 and the monolith 520 may form a greater than 90-degree angle (e.g., angle 542) with the floor surface 510 due to the angle of the floor surface. In alternative embodiments, the monolith 520 may be permitted to be at any angle with respect to a floor, ground, or other surface (e.g., a monolith may be connected with a decking, as previously discussed), whether or not the ground, floor, or other surface is horizontal or angled, in varying embodiments.

Figure 5B:
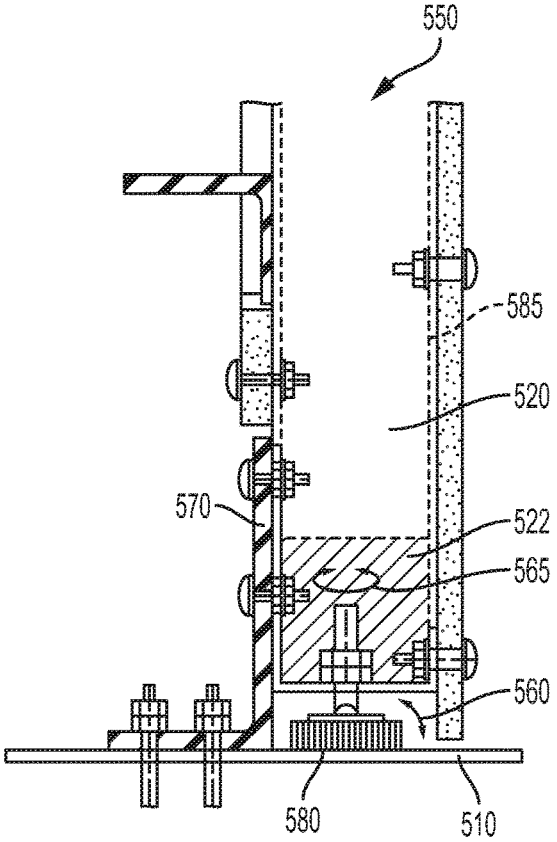
FIG. 5B shows a side schematic view of a possible connections associated with the monolith of FIG. 5A during assembly, according to one embodiment of the present invention.

For example, FIG. 5B shows a side schematic view 550 of possible connections associated with the monolith 520 of FIG. 5A during assembly. The monolith 520 may be connected to a ground or floor via an adjustable connector 580 that allows for both rotation 560 and/or spinning 565 of the monolith 520 with respect to the ground or floor 510 in one or more directions. Using such an adjustable connector may allow for creation of a play structure that is easily customizable for a particular topography since monoliths can be positioned, rotated, and/or spun in a variety of possible orientations prior to fixing such orientation in place (e.g., using one or more stabilizing connectors 570 such as brackets, bolts, welds, etc.), for example to stabilize the monolith, and/or without requiring the cost or expense associated with making a floor or ground surface into a particular orientation prior to build.

The monolith 520 may include a block or portion of material 522, for example, disposed at a lower end of the monolith 520 (e.g., positioned in the cavity between two side or surface panels) that engages with the adjustable connector 580. The block may be used for increased stabilization or support of the monolith 520. Equipment, such as plumbing 585, may be configured to be disposed at least partially within the cavity or gap internal to the monolith. As discussed, any of a variety of other features may be part of the monoliths, such as drain holes, connection holes, vertical adjustments of a ground connection, pivot points of a ground connection, horizontal adjustments of a ground connection, and/or other possible clamps or connectors (e.g., quick connects) associated with the assembly or connection of the monolith to the ground or floor surface and/or other associated components.

Figure 6:
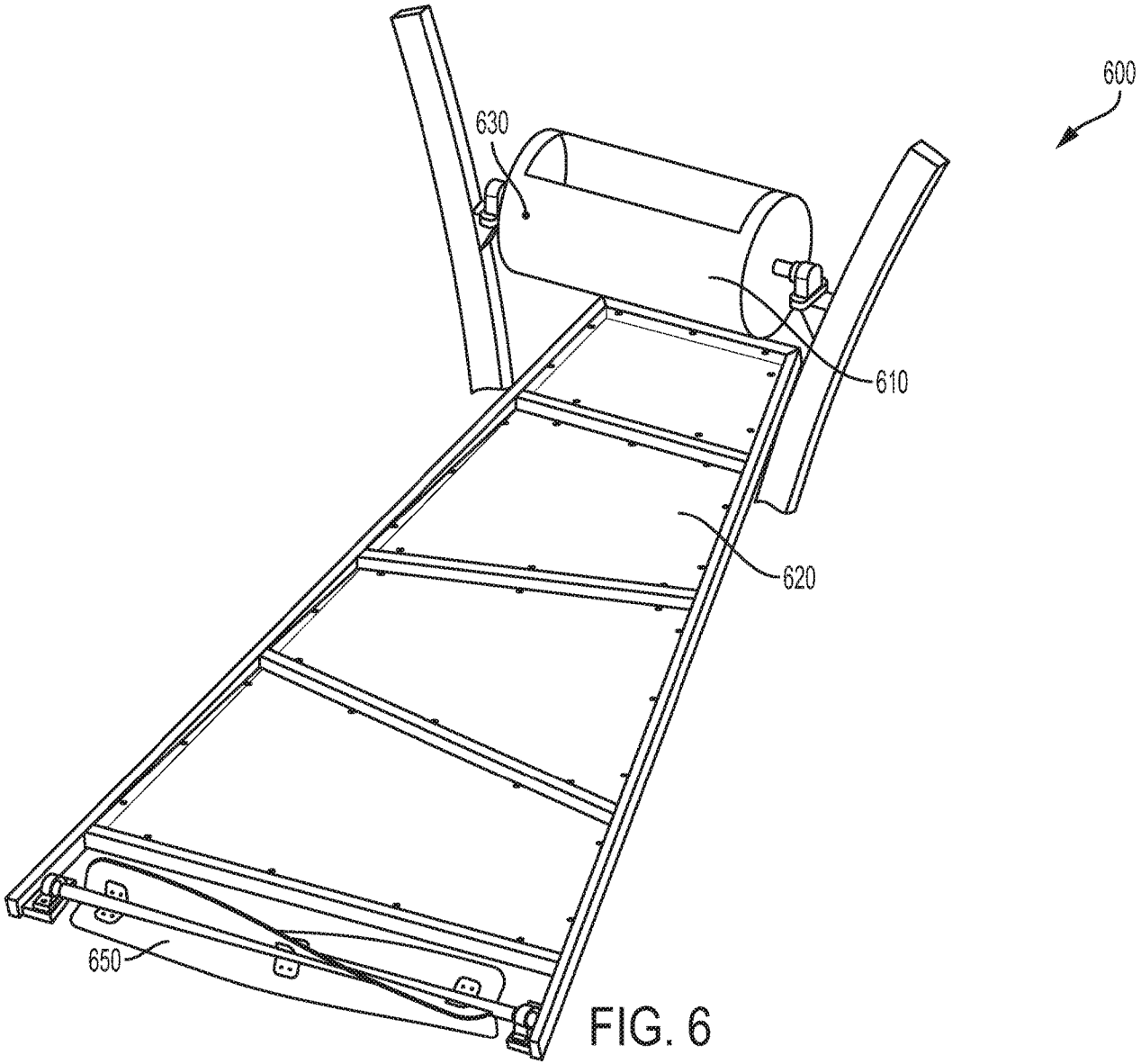
FIG. 6 shows a fluid dump system for a play structure, according to one embodiment of the present invention.

Water dumping or provision capabilities may additionally or alternatively be used as part of a play structure or standalone structure for user enjoyment. FIG. 6 shows a fluid dump system 600 for a play structure. Certain features of the fluid dump system 600 and/or the play structure may be the same as or similar to previous discussions. In certain embodiments, a fluid dump system, such as the fluid dump system 600 may be a standalone system that is not part of a larger play structure.

The fluid dump system 600 may include a fluid delivery element 610, illustrated in FIG. 6 as a rotatable or tippable element (e.g., a bucket, cylinder, sphere, or any other shape that is capable containing a volume of fluid, such as water) that is configured to subsequently release all or a portion of a volume of fluid that is contained within the element 610 at various intervals. Although the element 610 is illustrated as a rotatable or tippable enclosure, in an alternative embodiment, the release of all or a portion of the volume of fluid within the structure may be by way of rotating, pivoting, or otherwise releasing, such as by the opening of a portion of a side of the enclosure. In still another embodiment, no element 610 may be desired, instead water may be directly provided from a water source (e.g., piping).

In FIG. 6, the element 610 may be mechanically driven (e.g., caused to tip when the amount of fluid causes the bucket to become unsteady or otherwise too heavy to remain upright and tip over). In another embodiment, the element 610 may be electrically driven (e.g., caused to tip in response to an electrical signal, such as a signal based upon a measured weight, time, height of fluid within the element 610, etc. that exceeds a particular or predetermined threshold.

The element 610 may be provided in any of a variety of shapes although an elongated cylinder is specifically illustrated in FIG. 6. The element 610 may release some or all of the volume of fluid onto a fluid flowing element 620 (e.g., a further surface or plurality of surfaces or elements) that is configured to have the volume of fluid from the tippable element 610 disposed thereon). In one embodiment, the fluid flowing element 620 may be a static surface or set of surfaces having a particular shape, configuration, and/or orientation (e.g., stairsteps, drainage or fluid flow cavities or pathways, etc.) such that fluid being dumped or provided from the element 610 thereon flows in a particular fashion along the static surface, for example, downward due to gravity.

In another embodiment, the fluid flowing element 620 may be a surface or set of surfaces that are capable of moving (e.g., pivotable surfaces, such as curved surfaces) that are configured to rotate, pivot, spin, or otherwise move when a flow of water is deposited thereon, swaying, rotating, or otherwise moving back and forth as water continues to drain and/or flow over such surfaces. Such a configuration may provide for spillage of water in an exciting and/or unpredictable and splashing format that can provide more entertainment to users of the play structure.

At a bottom or lower portion of the fluid flowing element 620, a fluid encountering or dispersion element 650 may be disposed in order to provide a final surface (or set of surfaces), shape, or other component that causes a large splash of water to rain down upon users or other elements of the play structure. For example as illustrated, the fluid encountering or dispersion element 650 may be in the form of one or more elongated fins that are rotatable when fluid encounters the one or more fins. The fins may rotate along an axis substantially perpendicular to the flow of fluid along the fluid flowing element 620, or, in an alternative embedment, may be rotate along an axis at any other angle (or substantially parallel) with such fluid flow.

In one embodiment, users of the play center may witness or otherwise be aware that the element 610 is being filled with a fluid, such as water. The filling of the element 610 may be accompanied by visual notification of filling, audible notification, such as a bell or other sound, and or any of a variety of other notifications (e.g., physical notifications such as a vibrating floor, surface, or other element or structure). In certain embodiments, a further notification may be provided to users of the play structure at a predetermined time before the element 610 is due to tip and/or at a predetermined volume of fluid being within the element 610. For example, a bell or other sound may play in one embodiment when dumping of the water by the tippable element 610 is imminent.

In another example, some fluid from the element 610 (e.g., via an overflow hole 630, for example in the element 610) may provide the notification to users (e.g., once the element 610 has reached a certain volume such that fluid spills into an overflow hole of the element 610, other water dumping elements (may begin operation, thus indicating to users that the larger dumping of water from the element 610 is imminent. In still another example, fluid due to the overflow hole 630, similar to the description above, may instead be provided onto the fluid flowing element 620 such that users of the play structure witness fluid upon the fluid flowing element 620, but at a lower volume, indicating that a larger volume of fluid is due to hit the fluid flowing element 620 imminently.

Figure 7:
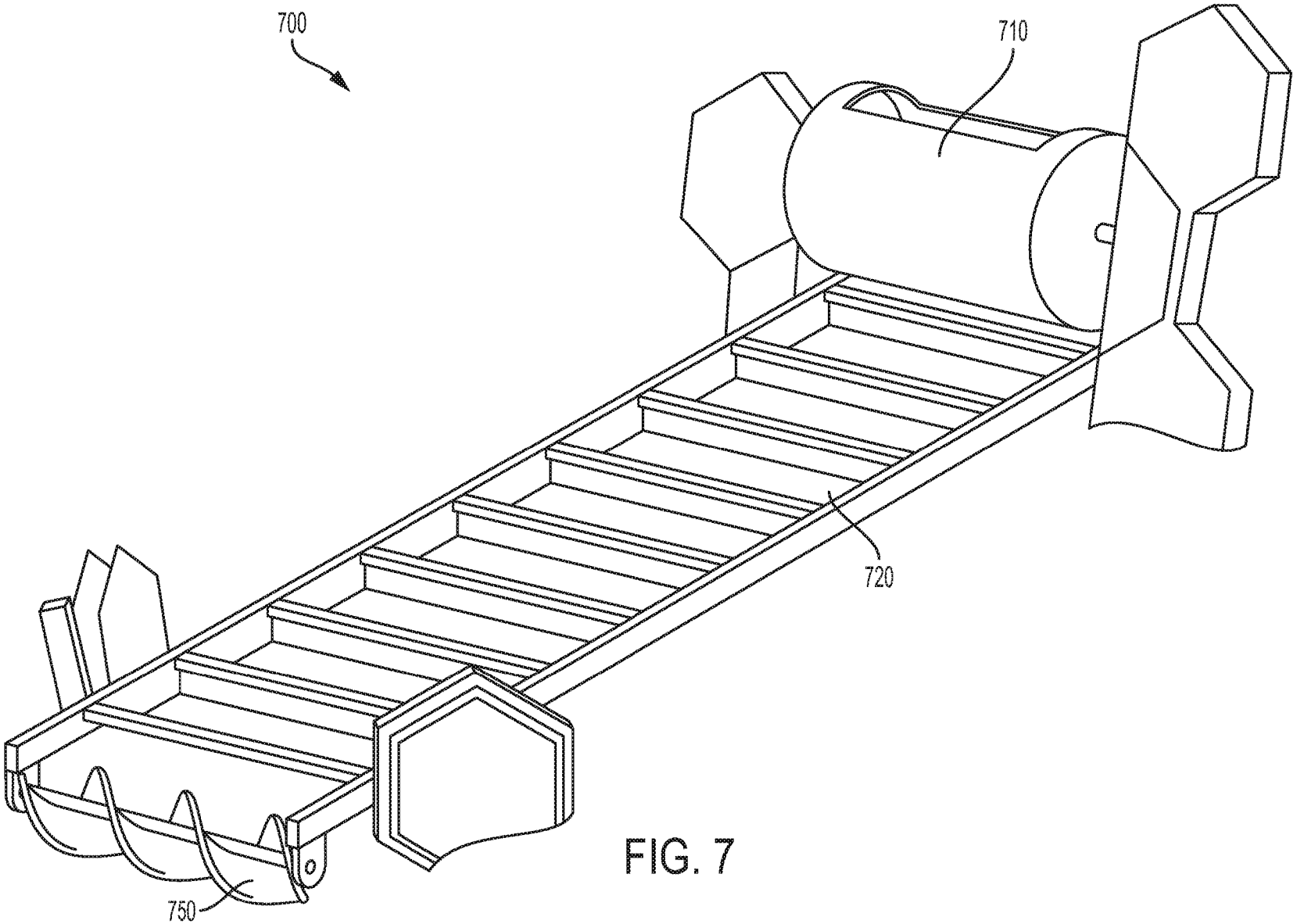
FIG. 7 shows a fluid dump system for a play structure, according to one embodiment of the present invention.

FIG. 7 shows a fluid dump system 700, for example, as part of a play structure. The fluid dump system 700 and/or play structure may include features that are the same as or similar to those previously discussed. For example, FIG. 7 illustrates a fluid delivery element 710, a fluid flowing element 720, and a fluid dispersion element 750. As shown, the fluid flowing element 720 may be comprised of a plurality of static steps or stairs that operates to cause fluid flowing on the fluid flowing element 720 to turbulently splash down the steps after the fluid is released from the fluid delivery element 710. The fluid dispersion element 750 may be in the form of a spiral or corkscrew, such that as fluid flows onto the fluid dispersion element 750 may cause the fluid dispersion element to rotate (if the fluid dispersion element 750 is rotatable), or otherwise cause fluid to fling, disperse or splash after it encounters the fluid dispersion element.

Figure 8:
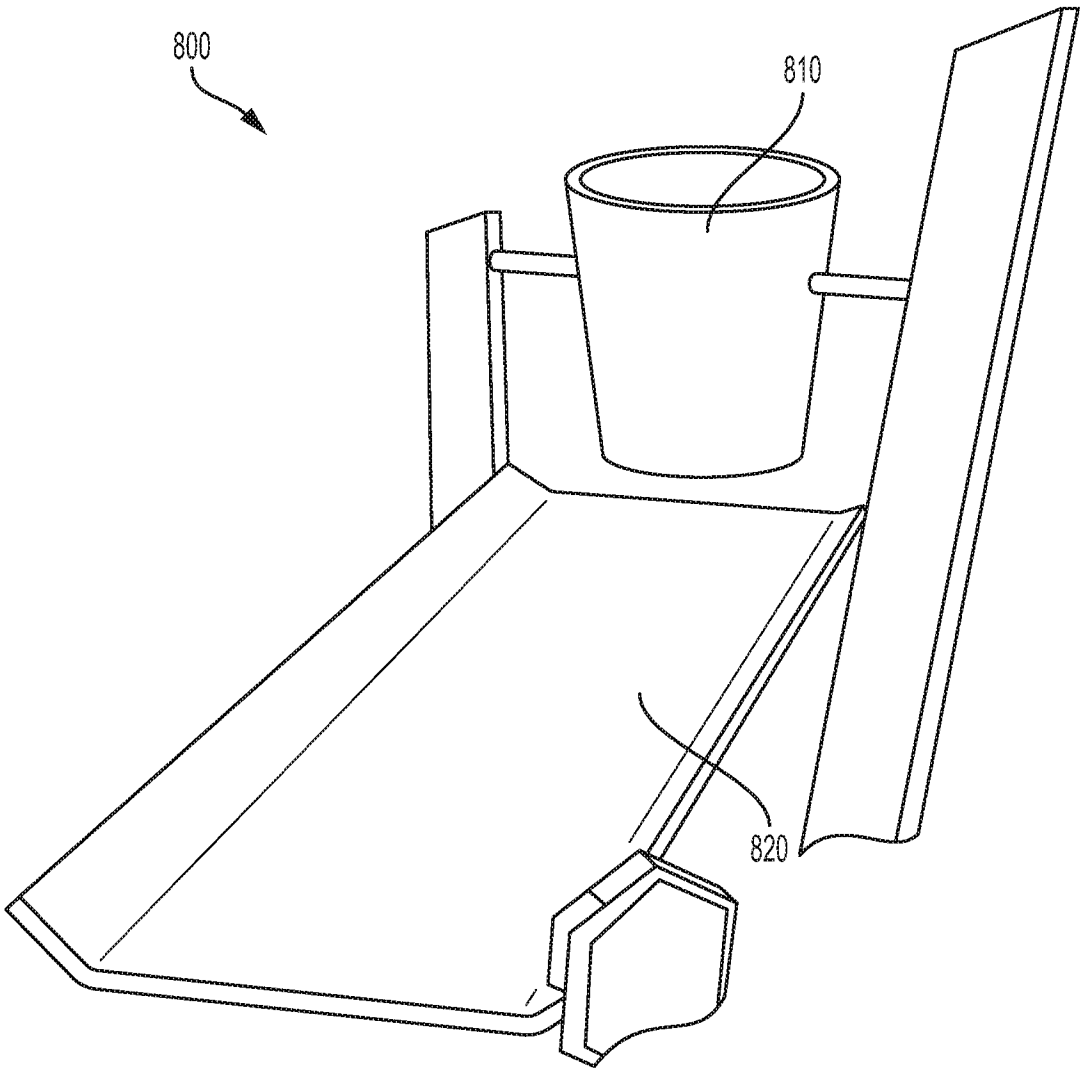
FIG. 8 shows a fluid dump system for a play structure, according to one embodiment of the present invention.

FIG. 8 shows a fluid dump system 800, for example, as part of a play structure. The fluid dump system 800 and/or play structure may include features that are the same as or similar to those previously discussed. For example, FIG. 8 illustrates a fluid delivery element 810 (e.g., a tippable bucket) and a fluid flowing element 820. As shown, the fluid flowing element 720 may be comprised of a generally flat surface (e.g., may include curved or angled sidewalls to aid in maintaining at least some of the flow of fluid there between). The fluid delivery element 810 provides fluid upon the static fluid flowing element 820 (e.g., a dump roof). The static fluid flowing element 820 may be made of a variety of materials and/or have a variety of textures, flow patterns or pathways, made in a variety of shapes and/or colors (e.g., translucent or semi-translucent), etc.

Figure 9:
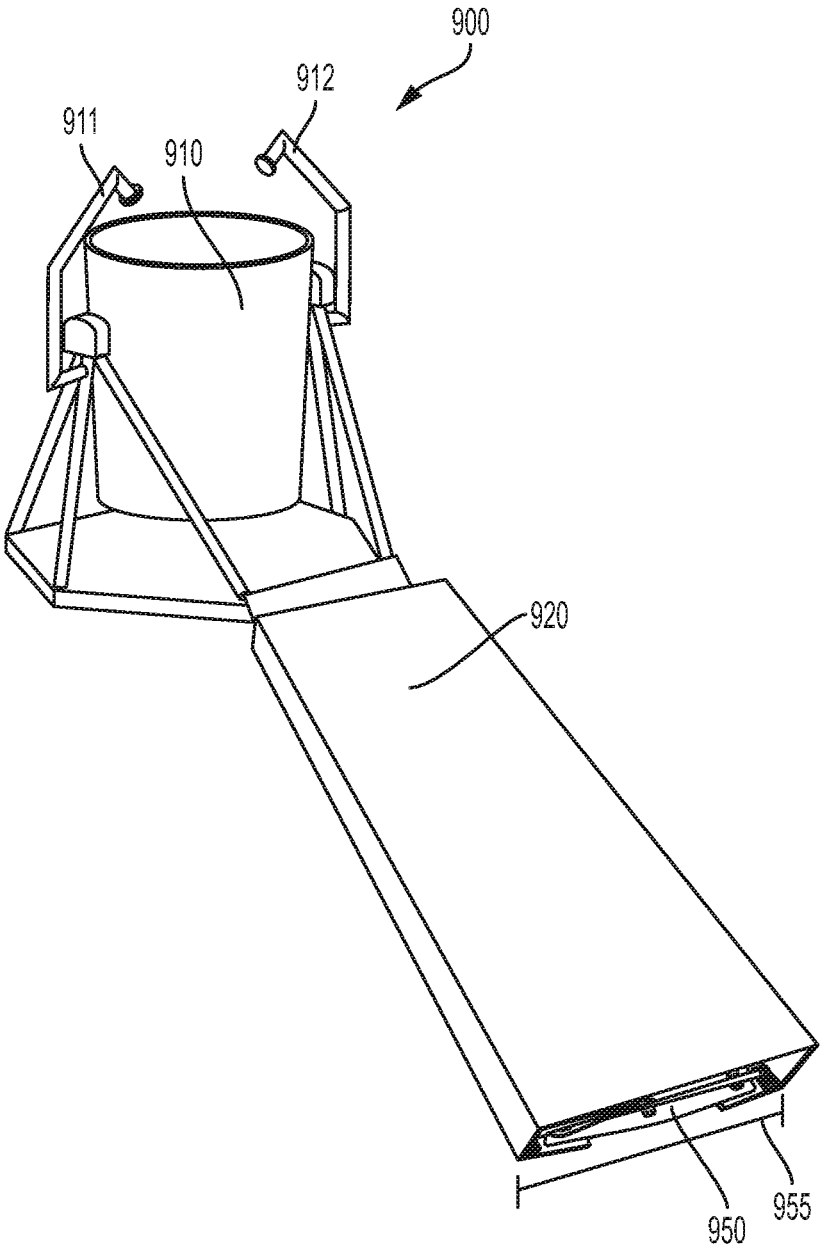
FIG. 9 shows a fluid dump system for a play structure, according to one embodiment of the present invention.

FIG. 9 shows a fluid dump system 900, for example, as part of a play structure. The fluid dump system 900 and/or play structure may include features that are the same as or similar to those previously discussed. For example, FIG. 9 illustrates a fluid delivery element 910 (e.g., a tippable bucket) having a plurality of fluid delivery sources (911, 912) for filling the fluid delivery element 910 with fluid, a fluid flowing element 920, and a fluid dispersion element 950. As shown, the fluid flowing element 920 may be comprised of a generally flat surface (e.g., illustrated without any sidewalls such that fluid may freely flow off lateral edges of the fluid flowing element 920). The fluid delivery element 910 provides fluid upon the fluid flowing element 920 (e.g., a dump roof), which subsequently provides at least some of the fluid flowing upon the fluid flowing element 920 to the fluid dispersion element 950. As illustrated, in one embodiment, the fluid dispersion element 950 may be in the form of at least one fin that is rotatably mounted at an end of the fluid flowing element 920 that is opposite the end of the fluid flowing element 920 adjacent to the fluid delivery component. The fin may extend substantially the entire width 955 of the fluid flowing element 920. As previously discussed, the static fluid flowing element 920 may be made of a variety of materials and/or have a variety of textures, flow patterns or pathways, made in a variety of shapes and/or colors (e.g., translucent or semi-translucent), etc.

Figure 10:
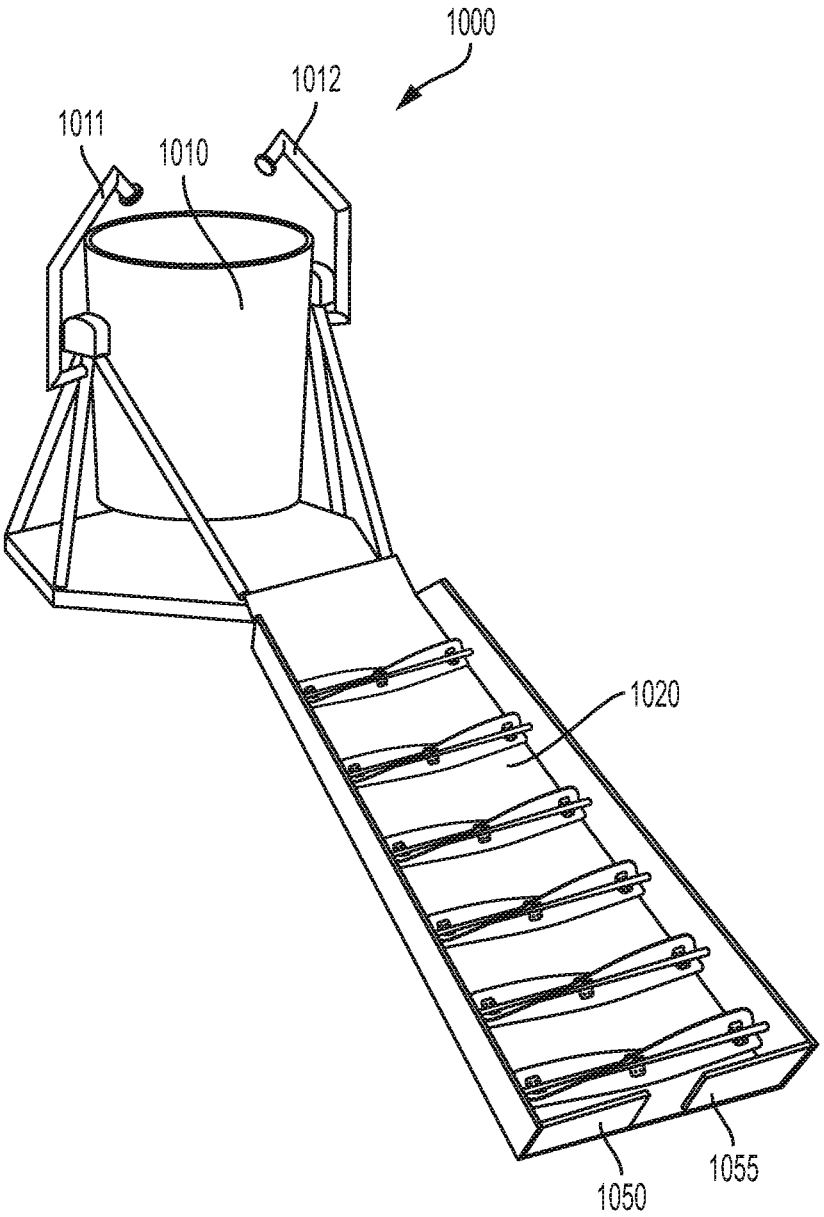
FIG. 10 shows a fluid dump system for a play structure, according to one embodiment of the present invention.

FIG. 10 shows a fluid dump system 1000, for example, as part of a play structure. The fluid dump system 1000 and/or play structure may include features that are the same as or similar to those previously discussed. For example, FIG. 10 illustrates a fluid delivery element 1010 (e.g., a tippable bucket) having a plurality of fluid delivery sources (1011, 1012) for filling the fluid delivery element 1010 with fluid and a plurality of fluid flowing elements 1020, for example, illustrated in FIG. 10 as a plurality of rotatable fin-based components configured to spin and rotate upon receiving fluid from the fluid delivery element 1010, the same as or similar to previous discussions. A first fluid dispersion element 1050 and a second fluid dispersion element 1055 (e.g., illustrated in the form of walls) encounter any fluid remaining after flowing down the fluid flowing elements 1020 and acts to disperse or splash such remaining fluid.

Figure 11:
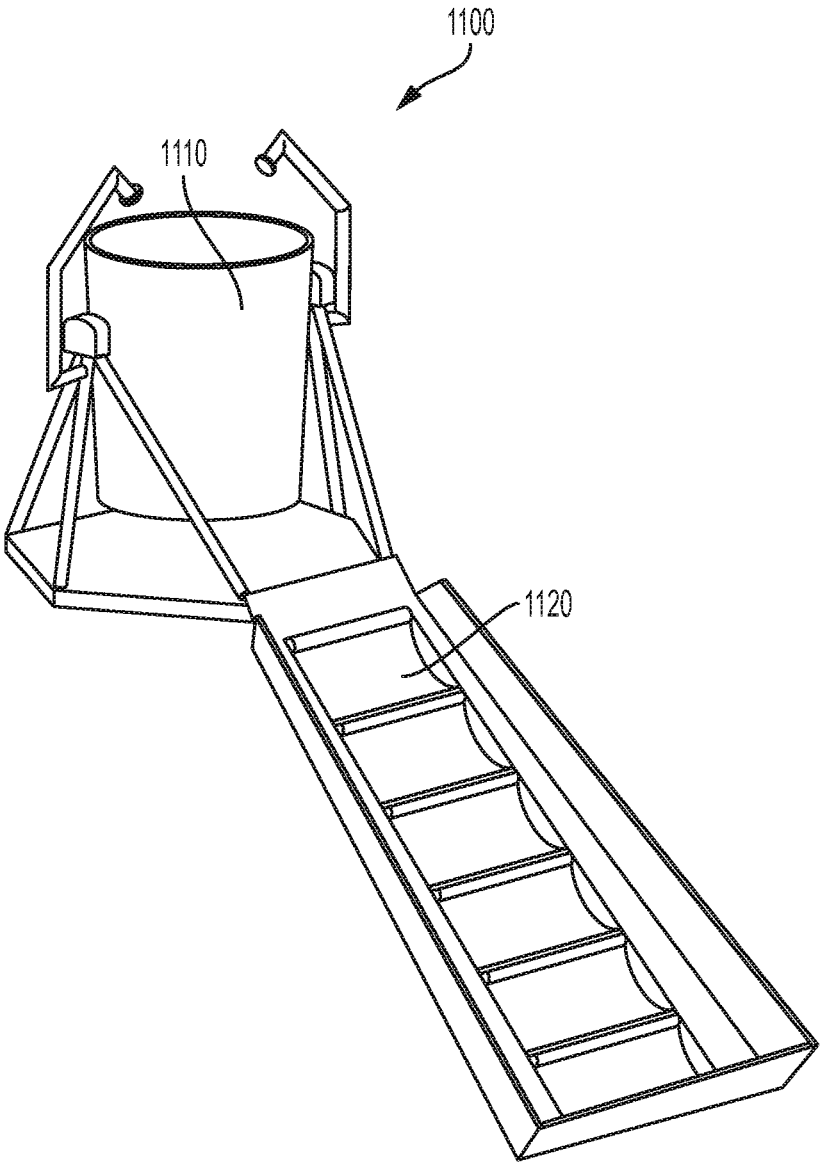
FIG. 11 shows a fluid dump system for a play structure, according to one embodiment of the present invention.

FIG. 11 shows a fluid dump system 1100, for example, as part of a play structure. The fluid dump system 1100 and/or play structure may include features that are the same as or similar to those previously discussed. For example, FIG. 11 illustrates a fluid delivery element 1110, a fluid flowing element 1120, and a fluid dispersion element 1150. As shown, the fluid flowing element 1120 may be comprised of a plurality of rotatable buckets that operate by rotating once fluid flows onto or into them and thus causing fluid flowing on the flowing element 1120 to turbulently splash down after the fluid is released from the fluid delivery element 1110. The fluid dispersion element 1150 may be in the form of wall that may cause any remaining fluid from the fluid flowing element 1120 to splash up and over the fluid dispersion element 1150.

Figure 12:
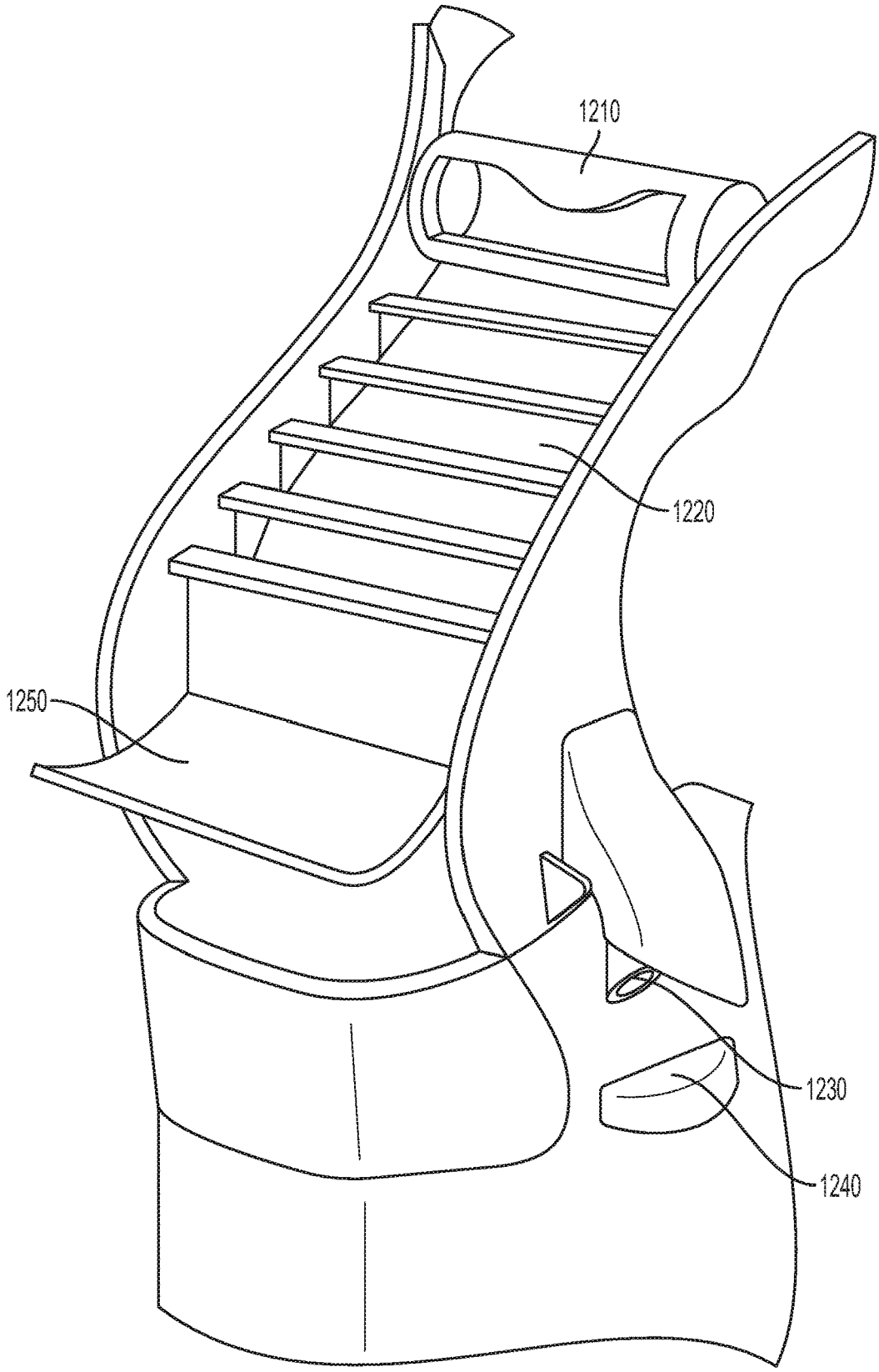
FIG. 12 shows a fluid dump system for a play structure, according to one embodiment of the present invention.

FIG. 12 shows a fluid dump system 1200, for example, as part of a play structure. The fluid dump system 1200 and/or play structure may include features that are the same as or similar to those previously discussed. For example, FIG. 12 illustrates a fluid delivery element 1218, a fluid flowing element 1220, and a fluid dispersion element 1250. As shown, the fluid flowing element 1220 may be comprised of a plurality of rigid steps or stairs that operate to cause fluid flowing on the flowing element 1220 to turbulently splash down the steps after the fluid is released from the fluid delivery element 1210. The fluid dispersion element 1250 may be in the form of a curved (e.g. or other shape) surfaces that acts to cause a final splash of fluid after the fluid encounters tire fluid dispersion element.

FIG. 12 also illustrates a second fluid flowing element 1230 and a fluid collection element 1240. The second fluid flowing element 1230 may be connected with the fluid delivery element 1210, for example, to begin flowing or pouring fluid from the fluid delivery element 1210 prior to the substantial release of fluid from the fluid delivery element 1210 onto the fluid flowing element 1220 (e.g., via connection with an overflow). Accordingly, in one embodiment, the flow of fluid via the second fluid flowing element 1230 into the fluid collection element 1240 may provide an indication to users that release of fluid from the fluid delivery element 1210 onto the fluid flowing element 1220 is imminent. Any of a variety and/or number of additional and/or alternative element may be coupled with a fluid delivery element, a fluid flowing element, and/or a fluid dispersion element (e.g., as discussed throughout) in order to provide additional water features, either at the same time, after in time, or prior in time, to the fluid being released from the fluid delivery element and onto the fluid flowing element.

Any of a variety of possible fluid dumping or other fluid providing systems may be used in an alternative embodiment. For example, such a system may include a roof or surface configured to carry water from an upper elevation (e.g., adjacent to a tippable element, such as a bucket) to a lower elevation. The roof or surface may be partially translucent and/or shaped in the form of a static, yet curved staircase. At the lower elevation, any of a variety of shapes or other objects or element may be adjacent to the end of the roof or surface, such as one having features the same as or similar to those previously discussed. In various embodiments, any of a variety of fluid delivering components or fluid sources may be disposed upon or connected with or adjacent a fluid flowing element, such as those previously described, or otherwise connected with the play structure (e.g., tippable cones, troughs having drainage holes, etc.) that react to water being disposed therein or thereon.

Although specific illustrations and embodiments have been discussed throughout, any of a variety of possible combinations and/or standalone elements may be used in alternative embodiments. Moreover, water dumping systems and/or components, and/or other elements or features of play structures discussed throughout the same as or similar to those discussed throughout may have their operation or capabilities varied based upon a number of further options or characteristics (e.g., time of day, user input, randomized, etc.). For example, if a play structure is intended to have users below a certain age playing thereon between certain hours of the day, a dumping mechanism may be configured to fill and/or dump a reduced volume of water, in recognition of the fact that smaller children may be participating thereon at such hours. In such a fashion, features and/or the experience of an attraction may change or be modified (e.g., automatically and/or manually by an attraction operator) in accordance with such possible inputs. In another example, an attraction may sense and/or determine a number of current participants and/or a number of current participants within a particular area and vary one or more features in response thereto (e.g., lower an amount of water dumped if the number of participants in the attraction and/or within a particular area of the attraction is below a certain threshold). Any of a variety of possible outcomes and/or operation may be varied or customized based upon a variety of possible inputs in alternative embodiments.

In certain embodiments, water that is dumped and/or otherwise provided from an element of a play structure may be configured to be recirculated and/or recycled and/or re-used back to such element, or another element. For example, if a dumping element causes water to be dumped onto a surface (e.g., a flooring or ground level) of a play structure, such flooring may include drains, slots, and/or otherwise contain porous features or drainage lines that allow such water to be collected in a reservoir (e.g., positioned beneath the play structure, such as beneath a flooring that the play structure is connected with). One large, common reservoir may be used and/or multiple reservoirs may be used in alternative embodiments. Various pumps and/or piping and/or other fluid recirculating elements may be used to bring water from the reservoir(s) back to one or more elements of the play structure.

As discussed, any of a variety of play structures (e.g., modular in nature) may be constructed in any of a variety of possible configurations and using any of a variety of possible traversal structures, such as slides or walkways, using the features described. Due to the connectible and manipulatable nature of monoliths and their connection with deckings and/or ground or other surfaces that may be placed in a variety of positions and/or orientations, and associated deckings that may attach to the monoliths, an easily configuration or modular play structure may be created with a variety of desired orientations. Non-interactive structures that not for user traversal may also be created using the concepts discussed, such as an overhead structure containing colorful transparent, semi-transparent, or non-transparent materials that thereby filter overhead lighting (or block lighting to provide shade) from lamps or the sun for user enjoyment).

The previous description of the disclosed examples is provided to enable any person of ordinary skill in the art to make or use the disclosed methods and apparatus. Various modifications to these examples will be readily apparent to those skilled in the art, and the principles defined herein may be applied to other examples without departing from the spirit or scope of the disclosed method and apparatus. The described embodiments are to be considered in all respects only as illustrative and not restrictive and the scope of the invention is, therefore, indicated by the appended claims rather than by the foregoing description. All changes which come within the meaning and range of equivalency of the claims are to be embraced within their scope. Skilled artisans may implement the described functionality in varying ways for each particular application, but such implementation decisions should not be interpreted as causing a departure from the scope of the disclosed apparatus and methods. The steps of the method or algorithm may also be performed in an alternate order from those provided in the examples.

What is claimed is:

1. A fluid delivery system comprising:

a fluid delivery element configured to contain a volume of fluid and release such fluid;

a fluid flowing element positioned adjacent to the fluid delivery element and separate from the fluid delivery element and configured to receive at least a portion of the volume of fluid from the fluid delivery element, wherein the fluid flowing element is a pivotable surface configured to move in response to the at least the portion of the volume of fluid from the delivery element; and a fluid dispersion element positioned adjacent to the fluid flowing element and configured to engage with at least a portion of the volume of fluid from the fluid flowing element.

2. The fluid delivery system of claim 1 wherein the fluid delivery element releases fluid via pivoting of the fluid delivery element.

3. The fluid delivery system of claim 2 further comprising an interactive fluid component and wherein the fluid delivery element is configured to pivot in response to a signal from a user interacting with the interactive fluid component.

4. The fluid delivery system of claim 1 wherein the fluid dispersion element is configured to rotate in response to the at least a portion of the volume of fluid from the fluid delivery element.

5. The fluid delivery system of claim 4 wherein the fluid dispersion element is configured to rotate about an axis that is perpendicular to the at least a portion of the volume of fluid from the fluid delivery element.

6. The fluid delivery system of claim 1 further comprising a notification element configured to provide a notification that the fluid delivery element is going to deliver the at least a portion of the volume of fluid from the fluid delivery element to the fluid flowing element.

7. The fluid dumping system of claim 6 wherein the notification element creates a sound effect, a lighting effect, a water effect, or a combination thereof.

8. The fluid dumping system of claim 6 wherein the notification element receives at least a portion of the volume of fluid from the fluid delivery element that does not release to the fluid flowing element.

9. A play structure comprising:

a monolith including:

a frame, a connector for fastening the monolith to a ground surface, a first surface connected with the frame, and surface, and a fluid conduit positioned within a volume formed by the first surface and the frame;

a decking connected with the monolith; and a fluid-based element connected with the monolith;

wherein the monolith is configured to rotate with respect to the ground surface via the connector.

10. The play structure of claim 9 further comprising an interactive element connected with the monolith, the interactive element configured to be interacted with by a user for a flow of fluid from the fluid conduit to the fluid-based component.

11. A play structure disposed upon a surface comprising:

a base segment;

a leveling element connected with the base segment for adjusting an orientation of the base segment relative to the surface;

a frame connected with the base segment;

a decking connected with the frame;

a fluid delivery element configured to contain a volume of fluid and release such fluid from the fluid delivery element; and a fluid dispersion element configured to receive at least a portion of the volume of fluid from the fluid delivery element.

* * * * *